US010787616B2

(12) United States Patent
Seccombe et al.

(10) Patent No.: US 10,787,616 B2
(45) Date of Patent: Sep. 29, 2020

(54) METHODS FOR SEPARATING LIGHT FRACTIONS FROM HYDROCARBON FEEDSTOCK

(71) Applicant: NEXCRUDE TECHNOLOGIES, INC., Dennis, MA (US)

(72) Inventors: Donald A. Seccombe, East Dennis, MA (US); Shujuan Wang, East Dennis, MA (US)

(73) Assignee: NexCrude Technologies, Inc., East Dennis, MA (US)

( * ) Notice: Subject to any disclaimer, the term of this patent is extended or adjusted under 35 U.S.C. 154(b) by 0 days.

(21) Appl. No.: 15/505,041

(22) PCT Filed: Aug. 20, 2015

(86) PCT No.: PCT/US2015/046156
§ 371 (c)(1),
(2) Date: Feb. 17, 2017

(87) PCT Pub. No.: WO2016/029046
PCT Pub. Date: Feb. 25, 2016

(65) Prior Publication Data

US 2017/0260461 A1 Sep. 14, 2017

Related U.S. Application Data

(60) Provisional application No. 62/039,865, filed on Aug. 20, 2014.

(51) Int. Cl.

| | |
|---|---|
| ***C10G 31/06*** | (2006.01) |
| ***C10G 5/06*** | (2006.01) |
| ***C10G 7/02*** | (2006.01) |
| ***C10G 53/02*** | (2006.01) |
| ***C10G 55/04*** | (2006.01) |

(52) U.S. Cl.
CPC ..... *C10G 31/06* (2013.01); *C10G 5/06* (2013.01); *C10G 7/02* (2013.01); *C10G 53/02* (2013.01); *C10G 55/04* (2013.01); *C10G 2300/1033* (2013.01); *C10G 2300/4006* (2013.01); *C10G 2300/4025* (2013.01); *C10G 2300/4068* (2013.01)

(58) Field of Classification Search
CPC ..... B01J 2219/00006
See application file for complete search history.

(56) References Cited

U.S. PATENT DOCUMENTS

| | | | | |
|---|---|---|---|---|
| 3,670,752 | A * | 6/1972 | Marsden, Jr. | F17D 1/16 137/13 |
| 4,900,347 | A | 2/1990 | McCue, Jr. et al. | |
| 5,030,339 | A | 7/1991 | Czarnecki | |
| 5,069,775 | A | 12/1991 | Grosboll | |
| 5,269,909 | A | 12/1993 | Ovalles et al. | |
| 7,175,696 | B2 | 2/2007 | Zhou et al. | |
| 2003/0070808 | A1 | 4/2003 | Allison | |
| 2008/0173531 | A1 | 7/2008 | Kesler | |

FOREIGN PATENT DOCUMENTS

| | | | | |
|---|---|---|---|---|
| GB | 331526 | A * | 6/1930 | C10G 7/00 |
| GB | 0331526 | A | 6/1930 | |
| WO | WO-2011/025613 | A1 | 3/2011 | |

OTHER PUBLICATIONS

International Search Report and Written Opinion for PCT/US2015/046156, dated Nov. 27, 2015, 12 pages.

* cited by examiner

*Primary Examiner* — Randy Boyer
(74) *Attorney, Agent, or Firm* — Procopio, Cory, Hargreaves & Savitch LLP

(57) ABSTRACT

A process for facile separation of lighter hydrocarbon fractions from the heavier fractions of hydrocarbon oil feedstocks is disclosed, which utilizes novel sparging and reverse distillation techniques. The present invention can be utilized for the facile "topping" of crude oil extracted on-site. Moreover, while heavier hydrocarbon fractions may be shipped to refineries for further processing, this invention will also prove useful for quick separation of light fractions produced by cracking processes off-site.

12 Claims, 4 Drawing Sheets

METHODS FOR SEPARATING LIGHT FRACTIONS FROM HYDROCARBON FEEDSTOCK

CROSS-REFERENCE TO RELATED APPLICATIONS

This application is an U.S. national stage application of International Patent Application No. PCT/US2015/046156, filed on Aug. 20, 2015, which claims priority to U.S. Provisional Application No. 62/039,865, filed on Aug. 20, 2014, the content of each of these applications is incorporated herein in its entirety by reference.

FIELD OF THE INVENTION

This invention generally relates to a process for facile separation of lighter hydrocarbon fractions from the heavier fractions of crude oil using sparging and/or reverse distillation methods.

BACKGROUND

Many technologies are known for processing crude oil extracted from underground sources. Typically, oil extracted from a reservoir is shipped off to refineries for refining. Perhaps the most popular refining method used is thermal cracking. Thermal cracking converts the high molecular weight hydrocarbons (heavy fractions) into lower molecular weight hydrocarbon molecules (light fractions). Some of the most frequently used cracking technologies include fluid catalytic cracking, delayed coker, and hydrocracking. Cracking technology is advantageous from the standpoint that it can be utilized to produce different types of fuel (kerosene, paraffin oil, etc.). Further, it is often used as a means for separating the newly formulated hydrocarbon fractions on the basis of their boiling point. However, the disadvantages include a high financial cost of cracking (specialized mechanical equipment) and the dangerous conditions (high temperatures and pressures) in which these processes operate. Thus, this type of processing is usually done substantially removed from the source of the feedstock.

The processes for producing asphalt and other petroleum products from crude oil residues often include a step-wise approach. First, the refiner does a straight reduction of crude oil. Then, a solubilizing, de-asphalting of reduced crude is performed. Finally, the residuals are thermally cracked. The straight reduction of crude oil usually involves a two-stage process. An atmospheric distillation column is used first to "top" the crude oil. This is followed by a vacuum distillation of the asphaltic residue and other petroleum products. Then, the lighter hydrocarbons are solubilized and separated from the remaining asphaltenes by the introduction of propane or pentane solvent. The asphaltic mixture thus obtained consists mostly of asphaltenes and viscous oil which will be cracked later in the process.

Although cracking can efficiently convert crude oil into more valuable cuts, one of the aspects less considered has been the total process throughput energy. Energy is need is extract the oil and ship it to refineries. But even more energy is needed to separate and refine oil enriched in the lighter fractions. Because the components of crude oil have boiling points which are close to one another, the amount of engineering and energy consumption required to isolate cuts of commercial importance is increased.

In addition to the above, there are many areas and countries that lack the infrastructure needed to locally refine crude oil using such conventional methods. Indeed, as the exploration for oil deposits is now pushing into the Artic, northern Canada, Africa, and the like, the energy sources required to build and maintain the infrastructure and machinery to capture these deposits often require importation of refined oil even though the crude oil is abundantly present at the location. Accordingly, there is a need to develop portable, robust, effective, energy-efficient methods of separating the usable, lighter hydrocarbon fractions for local or on-site use at otherwise inaccessible areas or areas lacking appropriate infrastructure.

SUMMARY

Various aspects disclosed herein may fulfill one or more of the needs identified above. In one aspect, this invention is directed toward a method and an apparatus which permit localized refining of a hydrocarbon oil feedstock compared to standard methods used by oil refineries. The claimed process comprises reverse distillation of the feedstock, particularly those characterized as heavy oil—oil which contains a significant amount of asphaltenes and other very high molecular weight fractions. The reverse distillation heats the feedstock to a temperature where two or more cuts will distill together instead of separately. The reverse distillation is optionally conducted in the presence of a sparging gas which is introduced to the feedstock during distillation. The hydrocarbon vapors are then cooled under controlled conditions such that the separation of the components is conducted by condensation rather than vaporization. In some embodiments, the hydrocarbon vapor is sequentially cooled to progressively cooler set temperatures, with each set temperature intended to condense and separate out another component or group of components. Compared to conventional methods, various embodiments of this disclosed process may advantageously produce: higher yields of lower boiling point components, and purer separated hydrocarbon products. A separated hydrocarbon product is "pure" if the recovered hydrocarbon components have the same or substantially the same boiling range defining that component (i.e., diesel having a boiling point range of 180° to 360° C. is considered "pure").

The methods of this invention also include distillation of selected components of a crude oil feedstock wherein the gaseous distillate (hydrocarbon vapor) comprises at least two different components which are selectively separated by condensation in modules of controlled temperature, wherein the feedstock is optionally sparged during the vaporization step, with an inert gas.

This invention provides systems, methods, and apparatuses for separating and processing crude oil feedstocks, particularly feedstocks which are characterized as heavy oil feedstocks. In one aspect of this invention, the apparatus is a single module or a series of modules, preferably of a size and conformation which allows the module(s) to be installed in remote areas. The first module is capable of heating an oil feedstock such that at least two different components of the oil feedstock are converted to a hydrocarbon vapor (i.e., gaseous phase). In various embodiments, the first module (i.e., the vaporization module) is coupled to a second module (i.e., a condensing module) via a vapor outlet having a vapor outlet valve disposed therein. Preferably, the vapor outlet is heated to a temperature such that the at least two different components remain in the gaseous phase, or only the component with the second highest boiling point and those boiling below it remain in the gaseous phase (i.e., the component with the highest boiling point condenses out of the gaseous phase). In various embodiments, the second module is set to a temperature that causes at least the component with the highest boiling point to condense out of the hydrocarbon vapor.

In one aspect, this invention is directed to a process for selectively separating the components of a hydrocarbon oil feedstock by heating the feedstock at a predetermined temperature such that two or more of the oil feedstock components are converted to hydrocarbon vapor, and then selectively condensing the vapor into individual component distillates. Optionally, an inert gas is sparged through the feedstock during the heating step.

In another aspect, this invention is directed to a process for selectively distilling two or more components of a hydrocarbon feedstock by sparging the feedstock with an inert gas at a distillation temperature that converts said components to a hydrocarbon vapor. The temperature needed to convert said components is advantageously reduced in the presence of gas sparging of said feedstock as compared to the absence of said sparging.

In one embodiment, the use of sparging will reduce the distillation temperature for a selected component of the feedstock by from about 0.1% to about 10%. In another embodiment, the distillation of the feedstock in the presence of sparging is conducted at a reduced pressure which further lowers the distillation temperature of a selected component and increases the overall energy efficiency of the process. It is contemplated that the energy savings arising from the methods of this invention will range from about 5% to about 10%, by about 15% to about 30%. by about 35% to about 50%, or by about 55% to about 75%, depending upon the feedstock used and other factors as described herein.

Without being limited to any theory, it is believed that the combination of sparging and reduced pressure permits distillation of a number of feedstock components at a reduced temperature, which is more energy efficient compared to traditional distillation. Distillation of feedstock comprising heavier fractions having higher boiling temperatures particularly benefits from sparging and reduced pressure during the distillation process. Thus, another aspect of the invention is directed to a distillation process in which higher boiling point components are recovered from the feedstock at a lower temperature than their standard boiling points; such a process is possible, at least in part, because sparging and reduced pressures reduce the boiling points of the components so as to render distillation more efficient.

In one aspect, there is provided a system comprising a series of modules, including a first module, a second module, and optional succeeding modules, which are in fluid communication with each other in the form of, for example, a gas or vapor, i.e., the modules are connected in series via one or more conduits, each conduit providing a path for gas or vapor to flow from one reservoir to the next In some embodiments, the first module is configured such that an oil feedstock within the module can be heated to a predetermined temperature, resulting in conversion of one or more components of the feedstock to a hydrocarbon vapor. In various embodiments, the hydrocarbon vapor produced by the first module is passed to the second module. The second and optional succeeding modules are each maintained at a temperature that causes a desired condensate to collect within the module(s), and the remainder of the vapor passes to the next module. Each successive module is maintained at a lower temperature than the preceding module so that each module collects a different component of the feedstock as a condensate. For example, a first cut of the highest-boiling component is condensed in the second module to recover a condensate of said highest-boiling component. Likewise, a third module, when present, is in fluid communication with the second module such that the hydrocarbon vapor remaining in the second module passes to the third module. In the third module, a second cut comprising the second highest-boiling component is condensed and recovered as a separate condensate.

In one aspect, there is provided an apparatus with a heater external to the vaporization module, such that a gas is injected into the hydrocarbon oil feedstock as it flows into and/or through the heater.

In yet another aspect, this invention arises at least in part from the discovery that the distillation can be controlled by initially heating the hydrocarbon feedstock to a temperature which selectively evaporates (i.e., converts to hydrocarbon vapor) those components of the feedstock capable of vaporization at that temperature.

These fractions (or cuts) ultimately may or may not be separated or fed back into the oil feedstock for additional separation. Lighter hydrocarbon fractions are separated from the heavier fractions according to the boiling point of their chemical constituents.

In yet another aspect, the present invention is directed to an improved method and apparatus for the separation and processing of crude oil, wherein increased yields of components such as petrol, naphtha, gasoline, diesel, and/or kerosene are contemplated to be produced.

In yet another aspect, this invention provides an improved method and apparatus for separating and processing both freshly extracted and residual crude oil.

Various aspects of this invention arise from the discovery that distillation can be controlled by initially heating a hydrocarbon feedstock to a temperature that converts those components of the feedstock selected for vaporization into a gaseous phase, and then controlling condensation of the components to effect separation.

Those skilled in the art will appreciate that the foregoing is a summary and thus, contains by necessity, simplifications and omissions of detail. Any particular system, device, or method may have some of or all these features or additional or alternative features. Other aspects, features, and advantages will become apparent in the teachings that follow.

BRIEF DESCRIPTION OF THE DRAWINGS

The above-mentioned aspects, as well as other features and aspects of this invention are further described herein with reference to the accompanying drawings, which form part of the present disclosure. The illustrated embodiments are merely examples and are not intended to be limiting. Other embodiments may be utilized and changes made without departing from the spirit or scope of the invention.

The aspects described herein and illustrated in the Figures can be arranged, combined, substituted, and designed in a wide variety of configurations, all of which are explicitly contemplated and form part of this disclosure. Unless specifically indicated, the features of the drawings are not drawn to scale.

DETAILED DESCRIPTION

Figure 1:
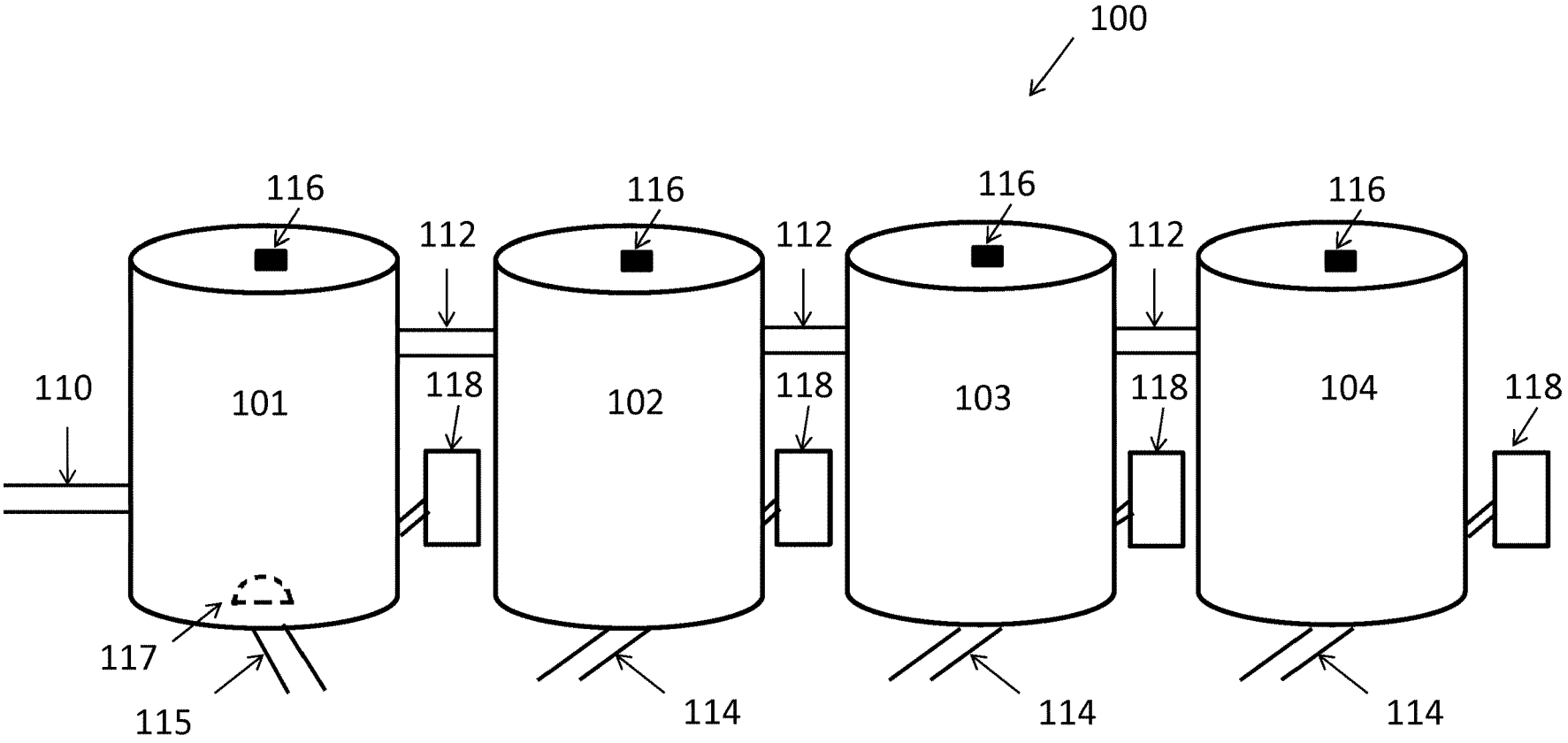
FIG. 1 illustrates a schematic representation of a distillation apparatus for separating the light hydrocarbon fractions, according to one embodiment.

This invention relates to the field of processing and separating crude oil extract containing both light and heavy hydrocarbon fractions. This invention can be utilized for the facile "topping" of crude oil extracted on-site. Moreover, while heavier hydrocarbon fractions may be shipped to refineries for further processing, this invention enables quick separation of light fractions followed by shipping the heavier non-distilled fraction for cracking processes off-site.

Definitions

Unless otherwise defined, each technical or scientific term used herein has the same meaning as commonly understood by one of ordinary skill in the art to which this disclosure belongs. In accordance with the claims that follow and the disclosure provided herein, the following terms are defined with the following meanings, unless explicitly stated otherwise.

The term "reverse distillation" as used herein, refers to the distillation process wherein at least two or more components in a given composition (comprising a plurality of mixed components) are initially vaporized. Subsequently, the desired components are separated by condensation into a different module(s), each of which is maintained at a specific temperature, in order to collect components on the basis of boiling point.

The term "hydrocarbon oil feedstock" or "oil feedstock" as used herein, refers to those hydrocarbon compounds, and mixtures thereof, which are in the liquid state at atmospheric conditions. The liquid hydrocarbon materials may have solids, including very small amounts of sulfur and other contaminants, suspended therein.

The term "component," as used herein, refers to those hydrocarbon fractions found in crude oil having art-recognized boiling points which distinguish one component from another. For example, diesel is a component of crude oil and represents fractions boiling in the range of 180° C. to 360° C. Likewise, naphtha is a component comprising a mixture of many different hydrocarbon compounds and has an initial boiling point of about 35° C. and a final boiling point of about 200° C. The slight overlap of components' boiling point ranges allows for flexibility in the separation process. As is apparent, since crude oil contains hydrocarbons of a wide range of molecular weights and chemical structures, there are numerous components which are recoverable as distillates. Representative components of crude oil are as follows:

refinery gas: small molecular weight gaseous hydrocarbons such as methane, ethane, propanes, and butanes;

petrol: pentanes-octanes;

naphtha: benzenes, pentanes, hexanes, and cycloalkanes;

gasoline/diesel: heptanes and octanes;

diesel: octanes-undecanes;

kerosene: duodecanes-hexadecanes;

lubricating oil;

fuel oil; and bitumen (Bunker fuel oil).

The term "fraction" or "cut," as interchangeably used herein, refers to the desired hydrocarbon components that are condensed and collected in modules during the distillation process.

The term "light fraction," as used herein, refers, in general terms, to those hydrocarbon compounds with boiling points that generally range from about 25° C. to about 250° C. under atmospheric pressure.

The term "heavy fraction," as used herein, refers, in general terms, to those hydrocarbon compounds with boiling points that generally range from about 250° C. to about 550° C. under atmospheric pressure.

The term "distillate," as used herein, refers to compounds of a hydrocarbon feedstock that are capable of distillation and which have been vaporized and may or may not have been condensed to the liquid phase during separation.

The term "non-distillate" as used herein refers to compounds of a hydrocarbon feedstock that are not capable of distillation and/or are not distilled in a given reverse distillation process.

The term "condensate," as used herein, refers to compounds which have been condensed from the vapor phase and are in the liquid phase.

The term "gas cap," as used herein, refers to the volume of space and general area located above the feedstock oil in a module. The vaporous hydrocarbons and other gases in the gas cap may leave the module via an outlet valve. In other embodiments, a gas may be introduced into the gas cap via an intake valve. The purpose of said gas may be to move the vapors along into the outlet valve and into the next module. Alternatively, the purpose of said gas may be to provide for a heat exchange. Yet again alternatively, the purpose of said gas may be to provide for a thermal equilibrium between the oil in the module and the gas cap residing above it.

The term "inert gas" as used herein, refers to a gas which, under the given conditions inside the apparatus, may contact but will not react with the hydrocarbon components in the feedstock. For example, under comparatively low temperature and pressure, methane gas may be introduced into the feedstock and yet, the methane gas will not participate nor start a chemical reaction. Other inert gases include, and are not intended to be limited to, carbon dioxide, nitrogen, argon, helium and the like.

The term "non-inert gas," as used herein, refers to a gas which, under the given conditions inside the apparatus, may contact and react with the hydrocarbon components in the feedstock. For example, under high pressure inside the module, high energy methane gas is introduced into the feedstock and participates in a homolytic chemical reaction. Such a reaction involves the methane gas participating by donating a hydrogen atom to an acceptor molecule. This molecule may or may not be a hydrocarbon in the feedstock. In other embodiments, the acceptor molecule is elemental carbon.

The term "sparging" or "sparge," as used herein, refers to introducing a gas at high velocity into the bulk of a liquid or oil, said gas having a lower density than the oil. Due to its lower density, upon introduction, the gas bubbles thru the liquid or oil.

The term "cracking" or "crack," as used herein, refers to the homolytic fission reaction of hydrocarbons wherein bigger compounds are broken down into smaller compounds.

For the purposes of this disclosure and unless otherwise specified, "a" or "an" means "one or more." At times, the claims and disclosure may include terms such as "a plurality," "one or more," or "at least one;" however, the absence of such terms is not intended to mean, and should not be interpreted to mean, that a plurality is not conceived.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% variation from the particular term.

All publications, patent applications, issued patents, and other documents referred to in this specification are herein incorporated by reference in its entirety as if each individual publication, patent application, issued patent, or other document was specifically and individually indicated to be incorporated by reference in its entirety. Definitions that are contained in text incorporated by reference are excluded to the extent that they contradict definitions in this disclosure.

The embodiments, illustratively described herein may suitably be practiced in the absence of any element or elements, limitation or limitations, not specifically disclosed herein. Thus, for example, the terms 'comprising,' 'including,' 'containing,' etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed invention. Additionally, the phrase 'consisting essentially of' will be understood to include those elements specifically recited and those additional elements that do not materially affect the basic and novel characteristics of the claimed invention. The phrase 'consisting of' excludes any element not specified.

This invention is not to be limited in terms of the particular embodiments described in this application, which are intended as illustrations of various aspects. Many modifications and variations can be made without departing from its spirit and scope, as will be apparent to those skilled in the art. Functionally equivalent compositions, apparatuses, and processes within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular processes, reagents, compounds, compositions, or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible sub-ranges and combinations of sub-ranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as 'up to,' 'at least,' 'greater than,' 'less than,' and the like, include the number recited and refer to ranges which can be subsequently broken down into sub-ranges as discussed above. Finally, as will be understood by one skilled in the art, a range includes each individual member.

Apparatus

The apparatus of various embodiments provides for the facile separation of the light fraction from the heavy fraction of a hydrocarbon feedstock. Such an apparatus is formed of a plurality of modules. Each module defines a reservoir configured to hold hydrocarbons in a viscous, liquid, or gaseous state. In various embodiments, the modules are connected in series via one or more conduits, each conduit providing a path for gas to flow from one reservoir to the next.

In one aspect, the invention provides for an apparatus for separating hydrocarbon oil feedstock. The apparatus comprises: a first module; an inlet configured to convey hydrocarbon oil feedstock to the first module; a second module; optionally, a plurality of other modules connected in series; one or more conduits, each containing an outlet valve, connecting the modules in series and configured to convey a hydrocarbon vapor from one module to the next module; a heating element external and/or internal to each module configured to set and maintain the temperature within each module; and, optionally, one or more gas inlets configured to convey sparging or hydrocarbon (return) gas to one or more of the modules.

In some embodiments, the sparging gas inlet(s) of the apparatus are coupled to a regulated gas feed line for conveying sparging gas to one or more of the modules. Additionally or alternatively, the apparatus for separating hydrocarbon oil feedstock may further include a fractionating column such as, for example, a metal ribbon, metal coils, metal mesh, woven metal or composite fibers, or other suitable material suspended or disposed inside a conduit and/or the reservoir of one or more modules. Such a column may have a surface temperature that is cooler than the surrounding temperature of the module or conduit and thus facilitate condensation onto the column.

Other components may also be included in the apparatus. For example, a reservoir or pipeline system may connect the inlet of the first module to a liquid hydrocarbon oil feedstock source. A reservoir or pipeline system may be connected to any module for collection of a hydrocarbon fraction product (i.e., component) formed within said module. A sparging gas capture system may be connected to any module of the apparatus. For example, a sparging gas capture system may be connected to the first and second modules; in some embodiments, the sparging gas capture system may capture sparging gas present within the second module and recycle it back into the first module for additional sparging. Additionally, a gas capture system may be connected to an outlet on the apparatus, allowing for capture of low molecular weight hydrocarbon gases and/or sparging gases, both of which may be recycled for re-injection as the system's sparging gas or collected for other use.

FIG. 1 schematically depicts one embodiment of an apparatus or system for separating hydrocarbon components. In the depicted embodiment, four modules 101, 102, 103, and 104 are connected in series. In other embodiments, the modules forming the system may vary in number. For example, in one embodiment, the system consists of two modules. In other embodiments, three, five, six, seven, eight, nine, ten, or more modules may be present within the system.

In various embodiments, the first module, for example, module 101, is a vaporization module. The module 101 is formed of one or more vessel walls, which define an internal reservoir. Vaporization is performed within the internal reservoir. In particular, hydrocarbon oil feedstock is introduced into the first module 101 via the feedstock inlet 110. The feedstock may come, for example, from a connected storage vessel and/or a direct source of hydrocarbon oil feedstock. In one non-limiting embodiment, the hydrocarbon oil feedstock is crude oil. When filled with a sufficient volume of hydrocarbon oil feedstock, the first module 101 is heated at or to a temperature T1 to produce a vapor V1 from the feedstock. In various embodiments, the temperature T1 is sufficiently high to vaporize all or substantially all components, or all or substantially all desired components, found in the feedstock. In various embodiments, the temperature T1 is greater than the boiling point of each desired component.

In some embodiments, to increase the speed and/or decrease the temperature of the vaporization process within the first module 101, the hydrocarbon oil feedstock within the first module 101 is sparged with a selected gas. A sparging gas may be delivered, for example, via sparging gas inlet 115. In some embodiments, a gas injector valve 117 is provided within the reservoir of the first module 101 and connected to the sparging gas inlet 115 to deliver the sparging gas into the first module 101. The gas injector valve 117 may be configured to inject the sparging gas in a plurality of directions. For example, in some embodiments, the gas injector valve 117 has a spherical head with a plurality of holes, which causes the sparging gas to spray in nearly every direction of the first module 101.

Additionally or alternatively, in some embodiments, to increase the speed and/or decrease the temperature of the vaporization process within the first module 101, the hydrocarbon oil feedstock within the first module 101 is heated under a partial vacuum. A vacuum system 118 connected to each of the modules is shown schematically in FIG. 1.

In various embodiments, the vapor, V1, generated within the first module 101 is passed to the second module 102, which is maintained at a temperature T2 that is cooler than temperature T1. In various embodiments, all components having a boiling point between T1 and T2 condense within the second module 102, and the remaining components remain as vapor. The condensed product, fraction 1 (F1), collects at the bottom of the reservoir of the second module 102 and is recoverable therefrom. For example, in some embodiments, the condensed product F1 collects at the bottom of the second module 102 and exits the module 102 via product outlet 114 when the product outlet 114 is opened, e.g. by a valve connected thereto.

In various embodiments, a plurality of hydrocarbon compounds (or components) are substantially isolated and captured in this manner. For example, in some embodiments, a vapor, V2, which includes all components having a boiling point higher than T2, is transported from the second module 102 to the third module 103. In the third module 103, the process is repeated at a temperature, T3, which is cooler than T1 and T2. In various embodiments, all components within V2 having a boiling point between T2 and T3 condense within the third module 103 and produce a condensed fractional product, F2. The process also produces a vapor, V3, which includes all components having a boiling point higher than T3. This process may be repeated one or more times with any suitable number of additional modules to obtain a corresponding number of additional fractions.

As seen in FIG. 1, in some embodiments, the modules of the apparatus 100 are connected to each other in series. In some embodiments, a conduit 112 connects two modules together such that the internal reservoirs of the two modules are in fluid (gaseous) communication. A conduit 112 is shown in FIG. 1, connecting the first module 101 to the second module 102; another conduit 112 connects the second module 102 to the third module 103; and another conduit 112 connects the third module 103 to the fourth module 104. In various embodiments, the connection between the conduit 112 and each adjacent module is liquid- and air-tight such that neither liquid nor vapor escapes from the internal reservoirs into the surrounding environment. For example, the first conduit 112 of FIG. 1 securely and tightly attaches to the first module 101 at a first outlet aperture and attaches to the second module 102 at a second inlet aperture; this setup enables vapor to travel from the first module 101 to the second module 102 without escaping the closed system.

In some embodiments, all or a portion of the functionality of the apparatus 100 is automated. For example, the first module 101 (i.e., the vaporization module) may have a feedstock flow rate sensor at its inlet 110 or a volume sensor within the reservoir of the first module 101 to monitor the amount of feedstock within the first module 101. Additionally or alternatively, the first module 101 may have a feedstock flow rate regulator at its inlet 110 to control the amount of feedstock entering the first module 101. In various embodiments, the first module 101 is run continuously or nearly continuously, such that, as feedstock is vaporized and the vapor exits the first module 101, additional feedstock is fed into the first module 101 via the feedstock inlet 110 to maintain a near constant volume in the first module 101.

A heat regulator 116 may be located external or internal to each module and may be configured to monitor and regulate temperature within each module. In preferred embodiments, the heat regulator 116 comprises a heat sensor disposed within the module, a heating element disposed within or connected to the module, and circuitry disposed within a protective casing either internal or external to the module. The heat regulator 116 of the first module 101 is configured to monitor temperature within the reservoir of the first module 101 and activate the heating element as needed in order to maintain the temperature at T1. The heat regulator 116 of the second module 102 is configured to maintain the temperature within the reservoir of the second module 102 at temperature T2, at least when the hydrocarbon vapor is provided for condensing within the second module 102. Similarly, the heat regulator 116 of the third module 103 is configured to maintain the temperature within the reservoir of the third module 103 at temperature T3, at least when the hydrocarbon vapor is provided for condensing within the third module 103. The heat regulator 116 of the fourth module 104 is configured to maintain the temperature within the reservoir of the fourth module 104 at temperature T4, at least when the hydrocarbon vapor is provided for condensing within the fourth module 104.

In some embodiments, a vacuum system or pressure pump 118 is connected to each module of the apparatus 100. In some such embodiments, a partial vacuum is created within each module to lower the boiling point of each hydrocarbon within the system, and thus, lower the temperature requirements of the system. Additionally or alternatively, in some embodiments, the vacuum systems 118 are provided to continuously or intermittently maintain a pressure differential between the various modules. In some embodiments, each subsequent module has a lower internal pressure than the preceding module. For example, at times, in FIG. 1, the second module 102 has a lower internal pressure than the first module 101, the third module 103 has a lower internal pressure than the second module 102, and the fourth module 104 has a lower internal pressure than the third module 103. Such a setup facilitates transport of vapor from one module to the next without the need for an additional pumping system.

In various embodiments, a valve is disposed within or adjacent to each conduit 112. The valve may be automated or manually controlled and comprises an open state and a closed state. The valve is reversibly closable. Accordingly, in such embodiments, the valves are closed and each module is maintained as a closed container while a vaporization or condensation process is occurring within the module's reservoir. When a particular time has passed or a particular condition has been reached, the conduit valve between the present module and the subsequent module is opened, and due to the presence of a lower pressure within the subsequent module, vapor is passively transported through the conduit to the subsequent module.

The apparatus of various embodiments provides for an overall energy savings over conventional devices since each of modules 2, 3, et seq., will not be continuously heating the remaining feedstock (e.g. the undesired components and/or non-dostollable components of the feedstock), as is the case with many separation technologies. In the presently disclosed apparatus of at least some embodiments, only vaporized and/or condensed components are present in each of the condensing modules. Additionally, in at least some embodiments, the energy to recover each product is less than simple distillation because each module is lined with an exchanger in order to recapture radiant heat and transfer it back to the first module feedstock. The process is run continuously in some embodiments until the first module needs to be emptied of residual feedstock.

Figure 2:
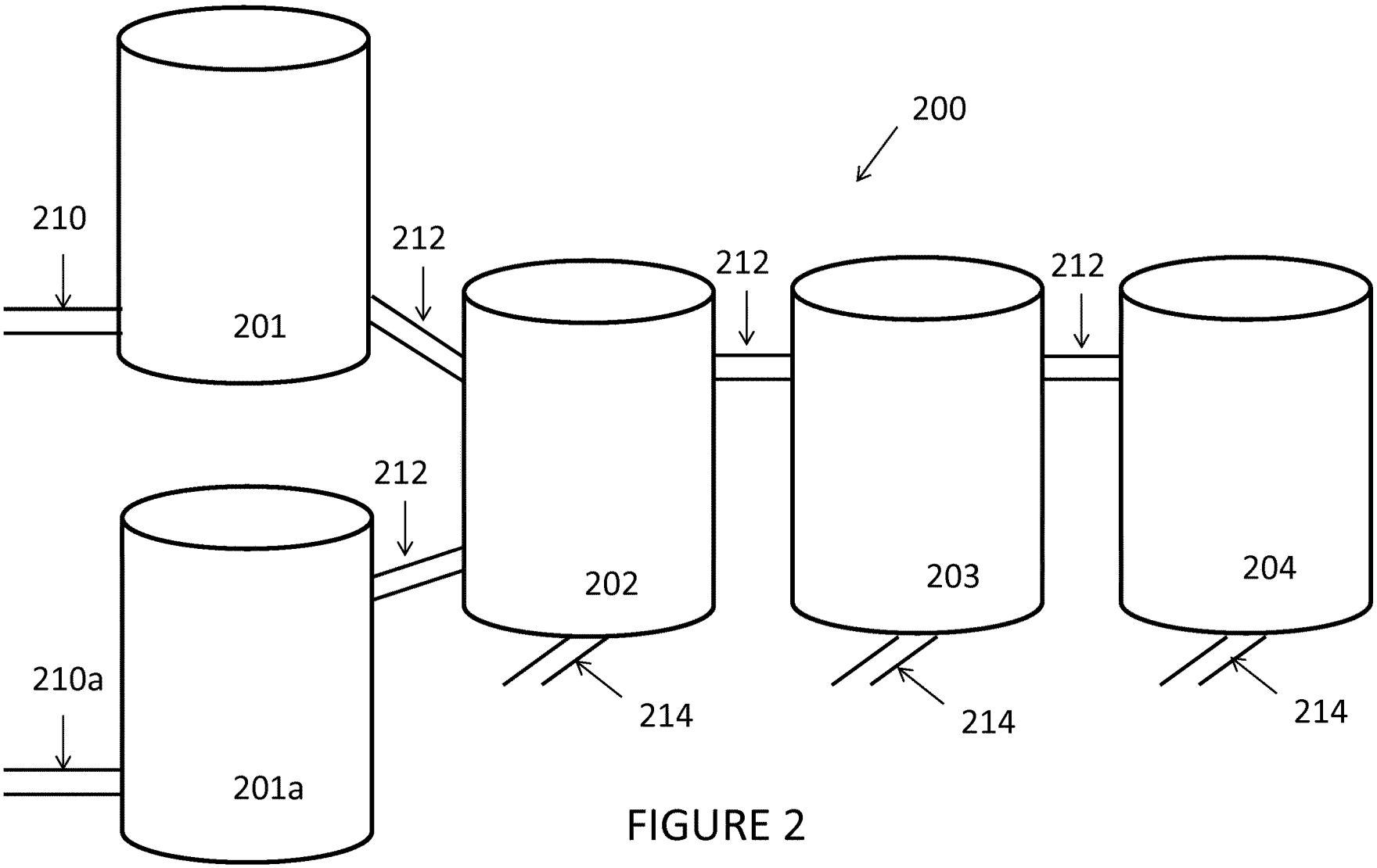
FIG. 2 illustrates another schematic representation of a distillation apparatus for separating the light hydrocarbon fractions, according to one embodiment.

Alternatively, as shown in FIG. 2, in some embodiments, a temporary module 201*a*, is introduced while the original vaporization module 201 is being "cleaned" or emptied of residual feedstock. In FIG. 2, two interchangeable vaporization modules 201, 201*a* are present. The vaporization modules 201, 201*a* receive a hydrocarbon feedstock from hydrocarbon feedstock inlet 210, 210*a*, respectively. In embodiments having two interchangeable vaporization modules, only one vaporization module is active at any one time. A conduit 212 connecting the inactive vaporization module to the first condenser module 202 will remain in a closed state, via a valve, during the duration of inactivity. As in FIG. 1, the apparatus 200 of FIG. 2 includes a plurality of condenser modules 202, 203, and 204, which are connected in series via conduits 212. Each condenser module in the apparatus 200 is maintained at a temperature that is cooler than the temperature of the preceding module, and each condenser module is configured to condense hydrocarbon compounds within a unique range of molecular weights and boiling points. Optionally, the apparatus comprises vacuum system(s) and/or heat regulators.

Figure 3:
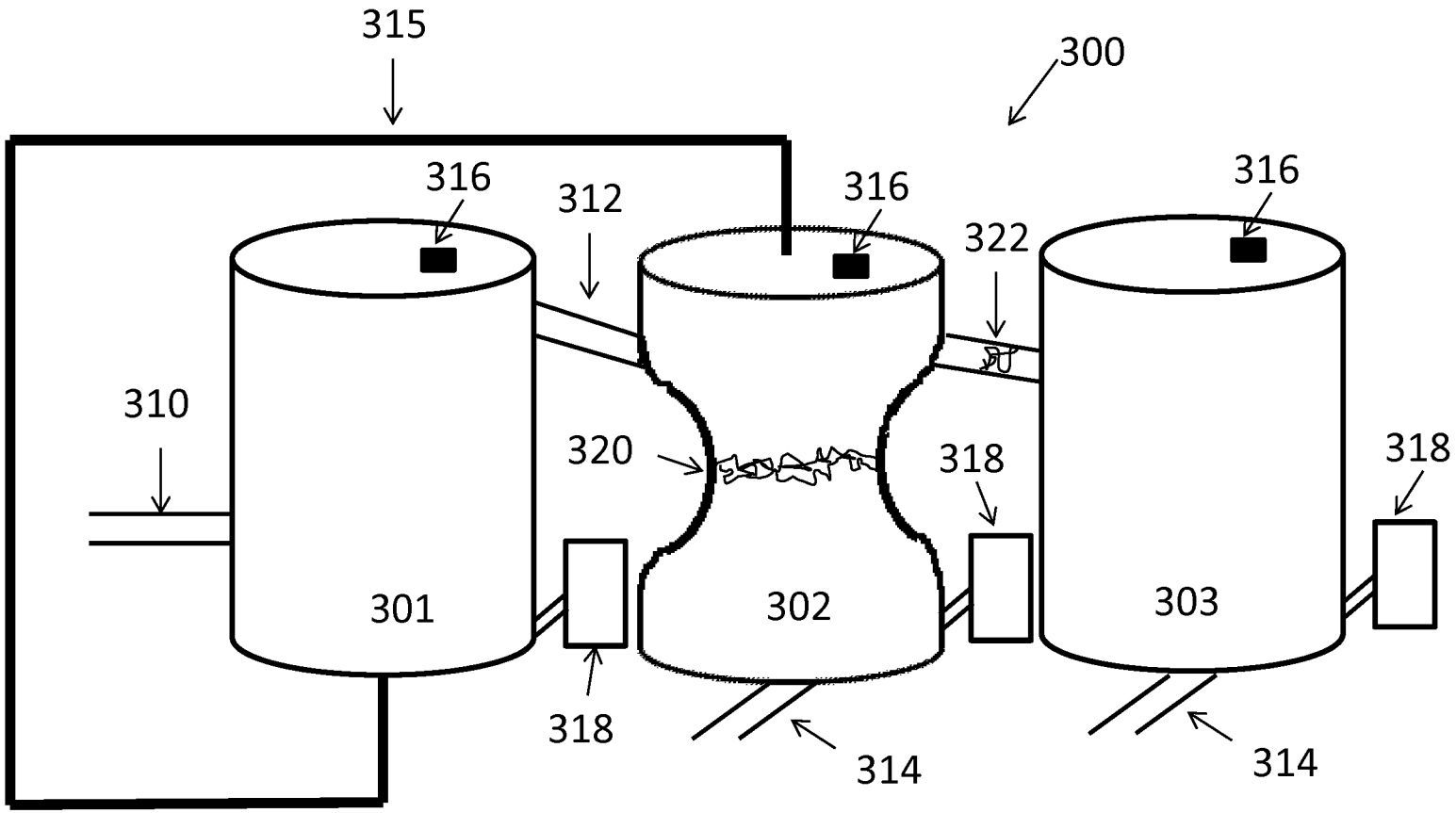
FIG. 3 illustrates another schematic representation of a distillation apparatus for separating the light hydrocarbon fractions, according to one embodiment.

As shown in the schematic diagram of FIG. 3, the various modules of a hydrocarbon-separating apparatus may come in a plurality of shapes and/or sizes. In some embodiments, one or more of the modules are spherical or cylindrical. In some embodiments, one or more of the modules have an hourglass shape. A condensing module of some embodiments has a top, middle, and bottom portion, and the middle portion has a circumference that is smaller than the circumference of the top and bottom portions. For example, module 302 of FIG. 3 illustrates such a shape. Such a shape may facilitate the condensation process and/or facilitate the capturing and recycling of sparging gases.

As shown in FIG. 3, the hydrocarbon-separating apparatus 300 has a vaporization module 301 and a plurality of condensing modules 302, 303. As in other embodiments, the vaporization module 301 receives hydrocarbon oil feedstock, for example, crude oil, from a feedstock inlet 310. The feedstock is loaded into and heated within the vaporization module 301 in order to produce a vapor having a plurality of vaporized components. The temperature is monitored and regulated using a temperature regulator 316. In some embodiments, the temperature at which the components vaporize is lowered within the module 301 relative to atmospheric conditions with the aid of a partial vacuum and a sparging gas. The partial vacuum may be generated by a pressure pump or vacuum pump 318 coupled to the vaporization module 318. The sparging gas enters through sparging gas inlet 315, and as described in more detail below, the sparging gas may be recycled from one or more of the condensing modules. The sparging gas inlet 315 may include a gas injector valve or nozzle, for example, as described above with reference to FIG. 1.

The vaporization module 301 is connected to the first condensing module 302 via a conduit 312. A reversibly closable valve is positioned within or adjacent to the conduit. In some embodiments, a vacuum pump 318 connected to the first condensing module 302 creates a pressure within the first condensing module 302 that is lower than the pressure within the vaporization module 301; accordingly, when the valve of the first conduit 312 is opened, vapor is passively transported from the relatively higher pressure vaporization module 301 to the lower pressure first condensing module 302. As shown in FIG. 3, in some embodiments, the conduits 312 may be angled downward such that the inlet to each conduit 312 is positioned vertically higher than the outlet to each conduit 312. Such a configuration is designed so that, if any vapor condenses within the conduit 312, the liquid will flow downward into the subsequent module.

In various embodiments, conduit 312 is positioned at or near the top of the condensing module. In some embodiments, the conduit 312 is positioned in the top half, third, quarter, or fifth of the condensing module. The gas entering the condensing module, particularly the first condensing module 302, comprises sparging gas and vaporized hydrocarbon components. The sparging gas of at least some embodiments has a lower molecular weight than the vaporized hydrocarbons. Accordingly, hydrocarbon vapor entering the first condensing module 302 via a conduit near the top of the module 302 will tend to fall towards the bottom of the module 302. The sparging gas will tend to remain towards the top of the module 302. Such natural separation by weight may allow sparging gas to be captured within a gas cap, transported via a gas line 315, and re-injected into the distillation module 301 for further sparging. Any lightweight hydrocarbon vapors collected within the gas cap may also be utilized as a sparging gas.

As shown in FIG. 3, in some embodiments, a condenser 320 is positioned within the condenser module 302. The condenser may be provided in any embodiment of the apparatus, including the embodiments of FIGS. 1 and 2. The condenser of some embodiments is disposed in one or more modules; additionally or alternatively, the condenser may be disposed in one or more conduits. The condenser may be suspended from a top wall of a module and hang downward, and/or a condenser may span all or a portion of a cross-section of a module or conduit. In the embodiment of FIG. 3, two condensers are present: one condenser 320 spans across a cross-section of a narrow, middle portion of the condenser module 302, and another condenser 322 spans across a cross-section of a conduit 312. Advantageously, within condenser module 302, as heavier hydrocarbon vapors fall towards the bottom of the module 302, the vapors will pass through, and come into contact with, the condenser 320. This may facilitate condensation of at least some of the hydrocarbon vapors. The condensed fractional products may be removed, for example, via product outlet 314.

Figure 4:
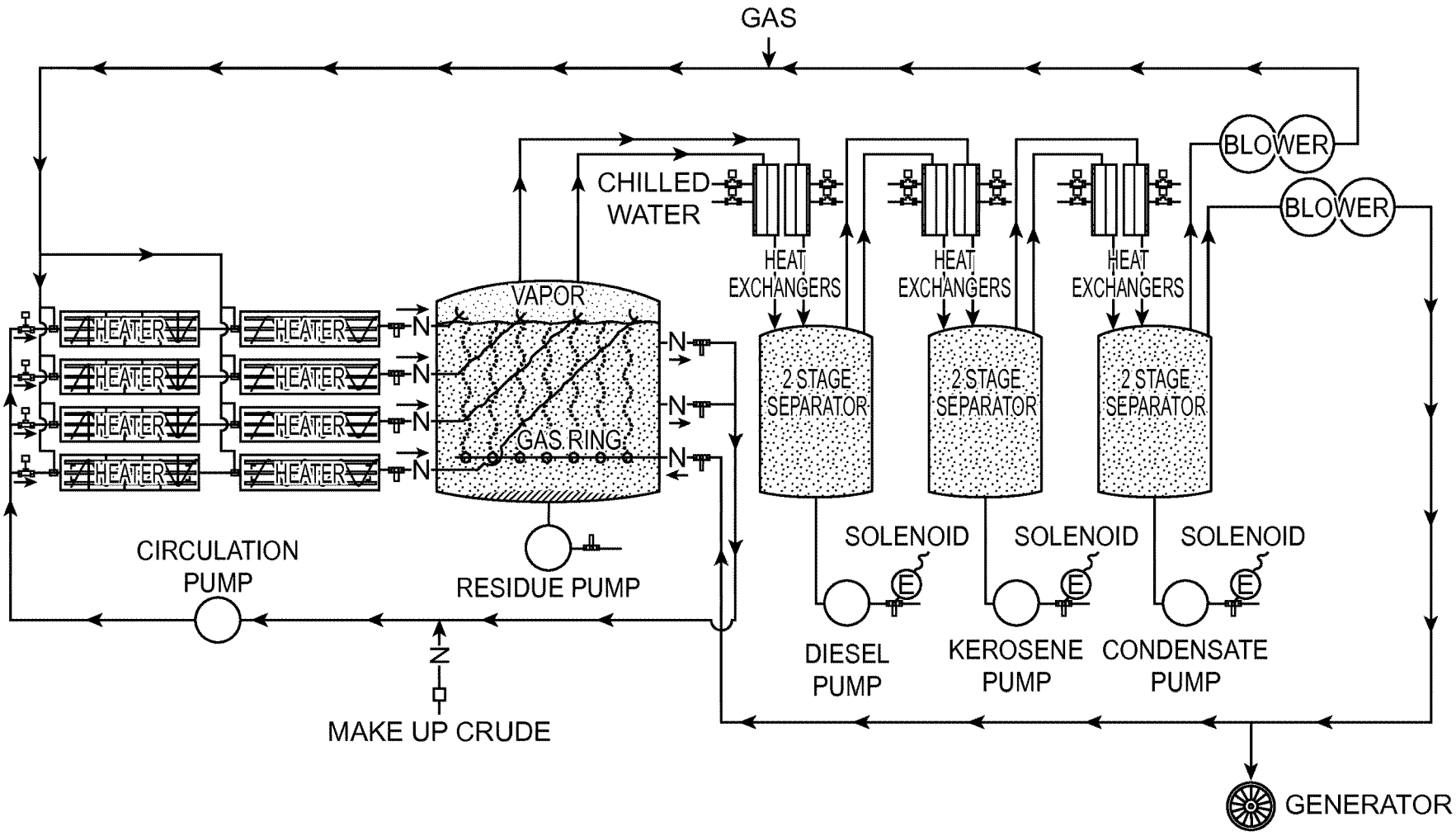
FIG. 4 illustrates an alternate embodiment of a distillation apparatus for separating the light hydrocarbon fractions.

As shown in FIG. 4, in some embodiments the hydrocarbon liquid is heated via external heaters prior to inflow into a vaporization module. In some embodiments, the hydrocarbon liquid (or a portion thereof) is removed from the vaporization module and cycled back through the heaters during vaporization. Additional hydrocarbon liquid (e.g. make-up crude) can be added to the cycled liquid prior to entry into the heaters. In some embodiments, gas is injected into the heater(s) with the hydrocarbon liquid. Without being bound by theory, it is believed that this allows the liquid to have full contact around the terminal inside the heater before flowing into and mixing in the vessel. In some embodiments, gas is injected into the vaporization module using a gas ring. Although multiple heaters and hydrocarbon liquid inlet valves are depicted in FIG. 4, a person skilled in the art would understand that one or a plurality of heaters and/or inlet valves may be used.

In some embodiments, the fractionating column(s) have a surface temperature which is cooler than the temperature within the module. In one embodiment, the column is a metallic coil, metallic or composite plate, metallic or composite mesh, or other suitable material, which is suspended in, or disposed within, the module or conduit in order to facilitate the condensation. These materials may be placed in any one of, or any such combination of, or all conduits and/or condensing modules of the apparatus.

In some embodiments, the apparatus comprises conduit(s) engineered with liquid sprayer(s) and paddle(s) or scrubber (s) in order to move the component(s) from the condenser housing.

In another embodiment, the apparatus comprises conduit (s) engineered with a valve-controlled drain or trap, or equivalent thereof, in order to move the component(s) from the condenser housing.

In one embodiment, the total number of modules is five. The temperature ranges of the second, third, fourth, and fifth modules are from about 375° C. to about 225° C., from about 160° C. to about 155° C., from about 150° C. to about 115° C., and from about 105° C. to about 20° C., respectively.

In another embodiment of the apparatus, the total number of modules is five. The temperature ranges of the second, third, fourth, and fifth modules are from about 375° C. to about 250° C., from about 190° C. to about 145° C., from about 120° C. to about 100° C., and from about 85° C. to about 0° C., respectively.

In another embodiment of the apparatus, the total number of modules is eleven. The temperature ranges of the second, third, fourth, fifth, sixth, seventh, eighth, ninth, tenth and eleventh modules are from about 375° C. to about 300° C., from about 275° C. to about 250° C., from about 225° C. to about 205° C., from about 200° C. to about 175° C., from about 150° C. to about 125° C., from about 100° C. to about 80° C., from about 75° C. to about 60° C., from about 55° C. to about 45° C., from about 40° C. to about 30° C., from about 27° C. to about 22° C., and from about 20° C. to about 5° C., respectively.

Various embodiments of the apparatus are intended to be at least partially portable. For example, in some embodiments, the various modules are pre-fabricated in a factory or other facility and transportable to the location of use. In some embodiments, each module is designed to be transportable by a tractor trailer. For example, in some embodiments, each module is substantially cylindrical and sized similar to the tank of a gasoline tanker truck. Such a module can be transported via truck to relatively remote locations for installation. In other embodiments, other sizes and shapes may be used with the specific dimensions of the apparatus selected based on the desired or available process throughput.

Processes

In one aspect, the separation process (and by extension the apparatus as well) can be run intermittently or continuously. In particular, the various stages or steps of the process may occur simultaneously or sequentially, such that a hydrocarbon feedstock can optionally be continuously fed to the first module (vaporization module) as the product hydrocarbon vaporized components are exited from that module.

The process comprises a first or vaporization module. The vaporization module is of a size and shape that facilitates vaporization and collection of the gaseous hydrocarbons (distillates). The vaporization module comprises an intake valve for receiving the oil feedstock and an outlet valve for recovering the distillates. In one embodiment, the outlet valve can be heated to maintain the distillate in gaseous form. Optionally, the vaporization module further comprises one or more gas inlet valves for injecting an inert gas into the hydrocarbon feedstock. The gas inlet valves allow the injection of gas directly into the feedstock and is preferably conducted at a high speed and temperature so as to facilitate vaporization of those components of the feedstock which have boiling points at or below the temperature employed. Without being limited to any theory, the underlying mechanism is proposed as follows. Heating of the feedstock produces a two phase system where the liquid hydrocarbon contains numerous gaseous pockets (bubbles) which have yet to be of sufficient energy to be released into the gaseous distillate in the gas cap above the feedstock. The introduction of high energy gas into the feedstock results in these hydrocarbon gas pockets associating with the high energy inert gas and being transported into the gas cap, thereby providing a more efficient means to capture the hydrocarbon distillate.

The temperature of the first module/vaporization module is maintained at a temperature where at least two and preferably a plurality of more than two distillable components of the feedstock are collected together in the gas cap. Unlike conventional distillation where each component is separated in a graduated temperature distillation, the reverse distillation captures as many distillable components as possible in a single heating cycle. The gaseous distillate is then transferred to a heated second module for condensation.

In a preferred embodiment, a series of condensation modules is employed with each module maintained at a temperature where only the component with the highest boiling point in the vapor phase is condensed. Accordingly, in such a series, the temperature of each subsequent module is maintained at a lower temperature than the preceding module. As would be understood by one skilled in the art, an alternative embodiment is to maintain a constant temperature for each module while adjusting the pressure upward in a sequential manner from module to module. This results in selective condensation in the same manner as reducing the temperature. Still further, one skilled in the art could readily adjust the temperature and pressure so as to selectively condense individual components of the distillate.

The distillate is retained in each module for a period of time to allow the component having the highest boiling point to condense, and each module has an outlet port for collecting the condensate. Accordingly, unlike conventional distillation where separation is based on boiling point of each component, the reverse distillation of this invention relies upon the condensation point of each component for separation.

As the distillate is transported from one module to another, the inert gas will be transported as well. Accordingly, in another preferred embodiment, one or more of the condensation modules can be configured to allow the inert gas to collect at the top of the module and then be recycled into the first/vaporization module.

It is contemplated that during the distillation, heating at increased temperature is a kinetic process and that condensation is a thermodynamic process subject to equilibrium. Thus, the reverse distillation process will be more energy efficient since the separation is based on condensation, which is more readily controllable because it is an equilibrium process.

In one aspect, the vaporization module is a pipe still or fractionating tower. In another aspect, the vapors move through the outlet valve which is connected, in series, to condensation modules. The outlet valves optionally contain suspended, suitable material which provides a surface for condensation. Each module is then maintained at a specific, differing temperature. The fractions collected are separated based on condensation temperature which is controlled according to the boiling point range of the chemical compounds that make up each individual cut or fraction (component).

Various suspend-able, suitable materials for the outlet valves are well-known in the art. These materials, sometimes called a fractionation column, can be heated and maintained at desired temperatures in order to facilitate the selective condensation of vapor. Such materials will be constructed to possess a high surface area and may consist of, for example, metal coils. It is well within the purview of the skilled artisan to engineer certain alloys or composites, and the like, in order to fabricate material suitable for the particular situation.

In one aspect, the invention arises from the discovery that the vaporization process is advantageously enhanced when sparging a composition of crude oil with a gas. Said gas is preferably an inert gas such as carbon dioxide, nitrogen, argon and the like. Alternatively, the process can be employed to effect molecular cracking of a portion of the feedstock by using a combination of higher temperatures, higher pressures and/or more energetic gas. In such an embodiment, the molecular cracking is facilitated by a source of hydrogen which can be provided by the injected, non-inert gas such as hydrogen, water, methane and other gaseous hydrocarbons. In such an embodiment, this invention provides for a method of molecular cracking of oil hydrocarbons by heating an oil feedstock at a temperature and pressure where the introduction of high energy, injected gas results in molecular cracking of at least a portion of the feedstock. Typical module pressure, module temperature, and gas injection rate and temperature, by way of example, is as follows: operating module pressure: about 75 pounds per square inch (psi); gas injection pressure: about 100 psi; gas injection temperature: about 180° C.; gas injection velocity: about 25 feet/second; and module operating temperature: about 620° C.

In one aspect, the invention provides for operating temperatures inside the module from about 0° C. to about 1100° C.

In one aspect, the invention provides for operating pressure inside the module from about −100 psi to about 500 psi.

In one aspect, the invention provides for operating gas nozzle injection pressure inside the module from about 1 psi to about 100 psi.

In one aspect, the invention provides for a module height to diameter ratio from about 2 to about 5.

In one aspect, the invention provides for a gas nozzle injection stream orientation of 0° to 45° that is referenced to the axis of the tank rotation.

In one aspect, the invention provides for a gas nozzle velocity of from about 0.25 to about 25 feet per second.

In one aspect, the invention provides for a gas injection process that is designed to create homogenous bubble flow or churn bubble flow with a transition region across the entire lower section of the crude oil volume that encompasses the surface of all heating elements. In one aspect, the invention provides for a gas injection process that is designed to create a heterogeneous bubble flow or churn bubble flow within the feedstock.

In one aspect, the invention provides for a heater surface temperature that can range from about 0 to about 1100° C.

In one aspect, the invention provides for an oil inlet temperature equal to or great that the feedstock oil temperature and less than or equal to the heater surface temperature.

In one aspect, the invention provides for a process wherein cuts or fractions may be collected as a very quick separation method which tops crude oil. That is, several of the "light" fractions may be collected together as one big fraction. A typically fraction collected in this way might be a fraction consisting of hydrocarbons which boil from about −161° C. to about 200° C. In another aspect, the be "light" cuts or fractions are collected in as many as about 20 differing, separated hydrocarbon components. These hydrocarbon components are separated, though they possess boiling points very close to one another. An example of such a separate fraction is as follows: $1^{st}$ fraction containing hydrocarbons with boiling points from about −161° C. to about 25° C., $2^{nd}$ fraction containing hydrocarbons with boiling points from about 28° C. to about 37° C., $3^{rd}$ fraction containing hydrocarbons with boiling points from about 39° C. to about 49° C., $4^{th}$ fraction containing hydrocarbons with boiling points from about 51° C. to about 60° C., $5^{th}$ fraction containing hydrocarbons with boiling points from about 62° C. to about 70° C., $6^{th}$ fraction containing hydrocarbons with boiling points from about 72° C. to about 80° C., $7^{th}$ fraction containing hydrocarbons with boiling points from about 82° C. to about 90° C., $8^{th}$ fraction containing hydrocarbons with boiling points from about 92° C. to about 100° C., $9^{th}$ fraction containing hydrocarbons with boiling points from about 102° C. to about 110° C., $10^{th}$ fraction containing hydrocarbons with boiling points from about 112° C. to about 120° C., $11^{th}$ fraction containing hydrocarbons with boiling points from about 125° C. to about 133° C., $12^{th}$ fraction containing hydrocarbons with boiling points from about 135° C. to about 143° C., $13^{th}$ fraction containing hydrocarbons with boiling points from about 148° C. to about 157° C., $14^{th}$ fraction containing hydrocarbons with boiling points from about 160° C. to about 169° C., $15^{th}$ fraction containing hydrocarbons with boiling points from about 171° C. to about 180° C., $16^{th}$ fraction containing hydrocarbons with boiling points from about 184° C. to about 192° C., $17^{th}$ fraction containing hydrocarbons with boiling points from about 194° C. to about 200° C. Such separations require precise control of temperature inside the system. This kind of control with separating the fraction or cuts is not limited to the "light" fractions, instead the separation of hydrocarbon components possessing boiling points above about 200° C. is also realized though not articulated thru example. Thus, the invention is also a separation of hydrocarbon components, from a feedstock, with boiling points from about −161° C. to about 600° C. As would be understood by a person skilled in the art, any two or more fractions may be separated, and/or various fractions may be combined to form multi-component fractions (e.g., the $1^{st}$, $2^{nd}$ and $3^{rd}$ fractions may be combined into a single fraction collected in one module, etc.).

Moreover, the invention is also not limited to separating hydrocarbon components by virtue of only wide or narrow differences in boiling point. In that regard, the invention is also a separation of hydrocarbon components, from an oil feedstock, in which the collected hydrocarbon fractions differ in boiling point by about 5° C., about 25° C., about 50° C., 7 about 5° C., about 100° C., about 150° C., or about 200° C. Such an example of a separation is as follows: $1^{st}$ fraction containing hydrocarbons with boiling points from about −161° C. to about 100° C.: $2^{nd}$ fraction containing hydrocarbons with boiling points from about 125° C. to about 200° C.; thus the difference in boiling point between the two fractions is about 25° C. Still further, as evidenced in the preceding example, the invention is not limited in the individual range of boiling points of hydrocarbon components within a fraction. Such differences of boiling points within a given fraction may be as great as about 5° C., about 25° C., about 50° C., about 75° C., about 100° C., about 150° C., or about 200° C.

As noted, various sparging gases known in the art can be used in the processes and apparatuses of the present invention. In some embodiments, the sparging gas is a non-inert, hydrogen-containing gas, such as, but not limited to, water, steam, pure hydrogen, methane, natural gas or other gaseous hydrocarbons. Mixtures of any two or more such hydrogen-containing gases may be used in any of the described embodiments. Further, non-hydrogen containing gases, such as carbon dioxide, helium, neon, argon, and xenon may be used either as diluent gases for any of the hydrogen-containing gases, or they may be used alone or in combination with liquid hydrocarbon materials.

In one aspect, the process provides for exemplary sparging gases including, but are not limited to, helium, methane, ethane, nitrogen ($N_2$), butane, butane, propane, propene, carbon dioxide, argon, xenon, and hydrogen ($H_2$), among many other gases. Specifically, in one aspect, the sparging gas is a hydrogen-containing gas, such as, but not limited to, water, steam, pure hydrogen, methane, natural gas or other gaseous hydrocarbons. Mixtures of any two or more such hydrogen-containing gases may be used in any of the described embodiment. Further, non-hydrogen containing gases, such as helium, neon, argon, and xenon may be used either as diluent gases for any of the hydrogen-containing gases, or they may be used with hydrocarbon feedstock, thus allowing for compositions with mixed physical properties. From the standpoint of energy, the sparging gas carries at least some portion of the bulk hydrocarbon into the vapor phase and thus, reduces the amount of energy need to distill and separate the chemical components of the hydrocarbon feedstock.

In one aspect, it is contemplated that although the system described in sparging is a heterogeneous liquid phase (a liquid phase containing gas bubbles through out), it is also contemplated that sparging can create a homogeneous system wherein the gas and liquid form a homogeneous colloid. In either event, the presence of the gas reduces the temperature for transporting hydrocarbon vapors from the oil phase to the gas cap.

In one aspect, the invention provides for method of distillation wherein the crude oil and/or condensates are sparged with gas at a pressure of about 10 psi.

In one aspect, the invention provides for method of distillation wherein the crude oil and/or condensates are sparged with gas at a pressure of about 20 psi.

In one aspect, the invention provides for method of distillation wherein the crude oil and/or condensates are sparged with gas at a pressure of about 50 psi. In one aspect, the invention provides for method of distillation wherein the crude oil and/or condensates are sparged with gas at a pressure over about 100 psi, over about 200 psi, or over about 500 psi.

In one aspect, the invention provides for method of distillation wherein the crude oil and/or condensates are sparged with gas at a rate of about 1 liter per minute. In one aspect, the invention provides for method of distillation wherein the crude oil and/or condensates are sparged with gas at rate of about 10 liters per minute, at about a rate of about 40 liters per minute, at about a rate of about 100 liters per minute, at about a rate of about 150 liters per minute, at about a rate of about 200 liters per minute, or greater than about a rate of about 300 liter per minute. When sparging is used, the gas is preferably heated to a temperature equal to or greater than the temperature of the hydrocarbon feedstock such that the gas does not create a heat sink when introduced into the distillation module.

In one aspect, the invention is directed toward a distillation process in which the distillation starts at very low temperature. For instance, the crude oil is distilled initially at about 10° C., under sparging with nitrogen gas. After such time has passed so that the desired fraction has been vaporized, condensed, and collected, the distillation may proceed at a higher temperature and the processes may be repeated. Said temperatures are then gradually increased at rate which affords separation of the light fractions from the crude oil in a feasible amount of time.

In one aspect, the invention decreases the amount of light hydrocarbon oil fraction that is contaminated with sulfur and other impurities. For instance, the present invention will increase the amount of sweet crude oil that can be collected from a distillation. Sweet crude oil contains a decreased amount of hydrogen sulfide and carbon dioxide impurities.

The size of each of the modules is dependent upon the desired amount of feedstock to be processed by the methods of this invention. In one embodiment, the size of each module is maintained at no more than 100 barrels of feedstock so as to allow ready transport and assembly at the point of use thereby rendering them "portable". This is in contrast to a fixed refinery infrastructure which processes many times more feedstock at any given time. Notwithstanding its rather small volume, the continuous nature of the process allows for a substantial amount of liquid distillate to be recovered. In some instances, such a small set of modules used to recover hydrocarbon distillate from a crude oil feedstock can be referred to as a "micro-refinery".

In another embodiment, the efficiency of this invention allows for modules to hold up to about 1000 or more barrels of oil at any given time. Such larger modules are desired, for example, when the need for fuel stocks extends beyond the reservoir site and into the local population.

In another embodiment, the invention allows for modules to process hydrocarbon oil feedstocks from a range of American Oil Institute (API) gravity including: from about 44° API to about 30° API, to about 20° API, to about 12° API, or to about 9° API.

In another embodiment, the invention allows for modules to be of sufficient size to hold about 300 barrels of hydrocarbon oil feedstock with about one-third of the volume of the module to be unfilled. In another embodiment, the invention allows for modules to be of sufficient size to hold about 200, about 175, about 150, or about 100 barrels of hydrocarbon oil feedstock with about one-third of the volume of the module to be unfilled.

The apparatus and processes thus generally described above, will be understood by reference to the following examples, which are not intended to be limiting of the apparatus or processes described above in any manner.

EXAMPLES

The distillation process utilizing the methods and apparatus as described herein are effective at separating out light hydrocarbon oil fractions. Illustrated below are predictive data for a typical apparatus.

Example 1

Evaluation of sparging gases. In this experiment, methane, nitrogen, and propane are investigated as the sparging gases at 10 psi pressure and at room temperature. The gas flow rate is up to 100 liter per hour through each inlet and the diameter of hole inside the module is equal to 5 cm. The distillate end of the gas inlet is in the form of a sphere with a multiplicity of holes; which allows the gas to exit from the sphere and mix with the feedstock in all possible directions. The sphere is located approximately between one-third and one-half deep into the liquid or oil phase. Gas chromatograms of the vapor, removed from overhead, will reveal that a significant portion, as determined by internal standard, of light hydrocarbon is volatilized relative to measurements without the sparging. A much smaller portion, as determined by internal standard, of heavy hydrocarbon is volatilized.

Example 2

Distillation of hydrocarbon feedstock: Crude oil is evaluated as the hydrocarbon oil feedstock. Vaporization is achieved by heating the crude oil to 450° C. and sparging with methane in at least the vaporization module. In this example, sparging will be conducted only in the vaporization module.

Table 1 provides representative ratios of heavy to light components in different hydrocarbon oil feedstocks, each of which can be used in this invention.

TABLE 1

| Hydrocarbon Feedstocks | |
|---|---|
| Feedstock | % Heavy/Light |
| 1 | 85/15 |
| 2 | 99.1/0.8 |
| 3 | 37.3/62.2 |
| 4 | 97.1/2.7 |
| 5 | 99.5/0.3 |
| 6 | 99.8/0.1 |

While certain embodiments have been illustrated and described, it should be understood that changes and modifications can be made therein in accordance with ordinary skill in the art without departing from the invention in its broader aspects as defined in the following claims.

What is claimed is:

1. An apparatus for separating one or more components from a hydrocarbon oil feedstock, the apparatus comprising:

a first module at a non-cracking first temperature having an inlet configured to convey hydrocarbon oil feedstock to the first module;

a second module at a second temperature which is below the first temperature connected to the first module by a conduit containing an outlet valve, and optionally a plurality of other modules connected in series, each module at a temperature below the temperature of the preceding module, wherein the modules are connected by one or more conduits containing an outlet valve configured to convey a hydrocarbon distillate vapor from one module to the next module;

a heating element external and/or internal to each module configured to maintain the temperature within each module; and one of more gas inlets configured to convey sparging and hydrocarbon return gas to one or more of the modules through a gas injection nozzle, wherein the hydrocarbon return gas is transported via a gas line and is re-injected into the first module.

2. The apparatus according to claim 1, wherein the apparatus further comprises a fractionating column in one or more modules or conduits.

3. The apparatus according to claim 1 or 2, wherein the hydrocarbon oil feedstock is crude oil.

4. The apparatus according to claim 1, wherein the modules have a temperature from about 0° C. to about 1094° C.

5. The apparatus according to claim 1, wherein the modules have an operating pressure from about−100 psi to about 500 psi.

6. The apparatus according to claim 1, wherein the gas injection nozzle has an injection pressure from about 200 to about 500 psi.

7. The apparatus according to claim 1, wherein the modules have a height to diameter ratio from about 2 to about 5.

8. The apparatus according to claim 1, wherein the gas injection nozzle comprises an injection stream orientation from about 0° to about 45° that is referenced to an axis of module rotation.

9. The apparatus according to claim 1, wherein the gas injection nozzle has an injection velocity from about 0.25 to about 25 feet per second.

10. The apparatus according to claim 1, wherein the gas injection creates homogenous bubble flow or churn bubble flow with a transition region across the entire lower section of the hydrocarbon oil feedstock volume that encompasses the surface of all heating elements.

11. The apparatus according to claim 1, comprising a hydrocarbon oil feedstock heater configured to heat the hydrocarbon oil feedstock prior to conveyance into the first module, wherein the heater has a surface temperature from about 0° to 1094° C.

12. The apparatus according to claim 11, wherein the inlet is at a temperature equal to or greater than the hydrocarbon oil feedstock temperature and less than or equal to the heater surface temperature.

* * * * *